US005964021A

United States Patent [19]

Stoffel

[11] Patent Number: 5,964,021

[45] Date of Patent: Oct. 12, 1999

[54] DOUBLE CHAMBER CONTAINER WITH TAPERING/CONICAL INNER CONTAINER

[75] Inventor: Hans F. Stoffel, Tuckahoe, N.Y.

[73] Assignee: IPC International Packaging Ltd., Switzerland

[21] Appl. No.: 08/686,573

[22] Filed: Jul. 26, 1996

[30] Foreign Application Priority Data

Jul. 28, 1995 [CH] Switzerland ..... 02210/95

[51] Int. Cl.[6] ..... B21D 39/00

[52] U.S. Cl. ..... 29/455.1; 29/516

[58] Field of Search ..... 206/511, 581; 29/455.1, 515, 516; 220/723

[56] References Cited

U.S. PATENT DOCUMENTS 5,388,716 2/1995 Stoffel et al. .

FOREIGN PATENT DOCUMENTS 0 017 147 3/1980 European Pat. Off. .

38 08 438 4/1989 Germany .

*Primary Examiner*—Joseph M. Moy

*Attorney, Agent, or Firm*—Wigman, Cohen, Leitner & Myers, P.C.

[57] ABSTRACT

The present invention relates to a method of producing a double chamber container with tapering/conical inner chamber for a pressure-valve can. The container is usable for dispensing flowable products, in particular, products containing solvents or products for the cosmetics industry, and comprises a single or multiple part metallic outer container and a compressible metallic inner container. The invention also relates to a double chamber container produced according to this method and its use in pressure-valve cans.

16 Claims, 3 Drawing Sheets

DOUBLE CHAMBER CONTAINER WITH TAPERING/CONICAL INNER CONTAINER

BACKGROUND OF THE INVENTION

The present invention concerns a method of producing a double chamber container for a pressure-valve can which is usable for dispensing flowable products, in particular products containing solvents or products for the cosmetics industry, having a single or multiple part metallic outer container and a compressible metallic inner container, as well as a double chamber container produced according to this method and its use in pressure-valve cans.

Such double chamber containers are found in about 2% of the approx. 6 billion spray cans used worldwide and have proven their worth in particular for the storage and dispensing of the most various types of products. Cans in which the propellant is separated from the filler product, hereinafter called double chamber cans, are of increasing importance; on the one hand, because the propellant used in such cans and which is usually flammable, such as butane, propane etc., is retained in the double chamber container and can be disposed of in a controlled manner, and on the other hand, because such cans permit the use of compressed gases, in particular air, nitrogen, carbon dioxide etc., which would chemically alter the filled products if these came into contact with the propellant.

Metallic containers, in particular those made of aluminium, are particularly suitable for the manufacture of such double chamber cans and are known, for example, from DE-38'08'438 or EP-017'147. These double chamber cans either have a plurality of parts, i.e. they comprise a rigid cylindrical casing part, a bottom part, a container lid (dome) and a flexible, metallic inner container, or they are made as two-part containers, i.e. they comprise a one-piece tapering outer container and a flexible, metallic inner container. These types of cans have a variety of technical drawbacks. Thus, when using different metals such as, for example, tinplate combined with aluminium, undesired bimetallic effects can occur at the seams which require special treatment. In other cases the adhesives used are not universally suitable for all types of filler products, therefore requiring an additional protective coating between the adhesive and the filler product. Last but not least, soldering or other types of bonding methods can lead to undesired deformations and weakened points in container parts which have been manufactured as thinly as possible, and thus do not fulfill the high standards set for pressure resistance.

Small containers are known in which a cylindrically formed inner container is inserted from above into a cylindrical outer container. These containers are sealed with conventional valves and therefore have an inner diameter of approx. 25.4 mm (1 inch). With this type of construction it is possible to manufacture containers having a filling capacity of 15–70 ml; however, this type of construction is not suitable for providing commercial pressure-valve cans having a filling capacity of commonly 70–250 ml or more because the intermediate space provided for the propellant between the outer container and inner container may not amount to more than 40% of the volume of the outer container, this standard varying from country to country. For example, under optimal conditions it is only possible to acheive a ratio of filling capacity to intermediate space volume of 45:55 by means of a cylindrical inner container having 80 ml filling capacity which has been inserted into an outer container whose aperture has a conventional valve closure of 1 inch diameter, this tapering outer container being 40×170.5 mm large and having a filling capacity of 175 ml. The only admissible ratio of 60:40 cannot therefore be reached with this type of construction.

This prior art makes it clear that the known methods of pressure proof fixation of the metallic inner container to the outer container are either technically complex (gluing and coating), can lead to insufficiently safe cans (weak points), or these cans are not suitable for large volume or true filling (waste of material, cheat packaging).

SUMMARY OF THE INVENTION

It is therefore the aim of the present invention to provide a universally usable, double-walled can body or double chamber container which can be manufactured in a technically simple and inexpensive manner, and which is also safe to use in cans with a large volume of filler product.

This is accomplished in a surprisingly simple manner by means of the features as described in claim 1 and with a container produced according to this method. The inventive method of manufacturing such a double-walled container is essentially characterized in that a preformed inner container, i.e. being essentially tapered towards the container opening, is introduced into an outer container and is attached thereto. In a preferred subsequent development the collapsible inner container is preformed in such a manner that it is frictionally engaged to the outer container in the region of a contact surface.

In a first embodiment of the production method, a first method step comprises tapering the inner container independently of the outer container and, in the case of a one-piece outer container, a second method step comprises introducing the inner container into an essentially still cylindrical outer container and positioning it in such a manner that this inner container is not deformed during further forming work on the outer container. This is made possible, on the one hand, by suitably dimensioning and forming the inner container and, on the other hand, by specially positioning this inner container inside the outer container. After formation of the outer container has been completed, the inner container is moved into its final position and is then connected to the outer container.

In a preferred embodiment of the invention, the inner container comprises a cylindrical neck portion which is inserted into a likewise cylindrical neck portion of the outer container. To mutually connect the two portions, the opening edge of the outer container is beaded inwardly in such a way that an inwardly open, ring-formed groove is created in which the opening edge of the preformed inner container is inserted to be further rolled inwardly together with the groove-shaped beading of the outer container. The opening edge of the inner container is preferably formed inwardly, in order to provide a ring-like surface which fits snugly in the groove-shaped beading.

In another embodiment of the invention, the neck portion of the inner container is dimensioned and formed in such a way that in its end/final position after insertion, its opening edge overlaps the inwardly or outwardly rolled edge of the inner container. In a further method step, the portion of the inner container overlapping the outer container is folded over the rolled edge of the outer container. In this particular embodiment, the inner container can have a particularly formed area which, upon contact with the outer container, determines the final position of the inner container.

In a further development of the invention the cylindrical neck portion of the inner container lies in frictional engagement with the cylindrical neck portion of the outer container.

Basically, each part of the inner or outer container can be in frictional engagement with the respective other container and retain the inner and outer containers in a fixed position to each other, i.e. eliminating the need for special retaining means. Further, with such a frictional engagement area, the adhesive or sealing area can be placed underneath the neck portion which possibly still has to be formed or clinched.

In yet a further embodiment of the inventive production method a multiple part outer container is used, whose bottom portion or lid portion (dome) is not yet attached to the casing part. On the other hand, the inner container is formed independently of the outer container and is subsequently inserted into the casing part. The inner container can be inserted from the bottom side until the opening edge of the tapering inner container comes to lie in the opening of the outer container, in order to be attached there. For example, if the outer container has an outwardly beaded opening edge, the inner container is formed such that it extends through this opening edge and, after being suitably formed, can be folded over this opening edge. In another case the inner container is inserted into the casing part of the outer container via its lid side, the lid part is attached to the casing part without deforming the inner container, and the inner container is attached to the lid opening, if this has not already been done prior to the insertion operation. Here too the edge can be beaded either inwardly or outwardly. An additional pressure-proof attachment or sealing can be carried out in a subsequent method step.

The advantages of this type of construction are immediately obvious to the expert and lie in the surprisingly simple technical production method for double walled can bodies, which permit the manufacture of operationally safe double chamber pressurized cans also for filling volumes above 70 ml.

A further advantage is to be seen in the fact that the intermediate space for the propellant can be kept as small as necessary, thereby minimalizing the material required for the outer container.

BRIEF DESCRIPTION OF THE DRAWINGS

In the following, the invention is to be described more closely and with the aid of the figures, in which.

DETAILED DESCRIPTION OF THE PREFERRED EMBODIMENTS

Figure 1B:
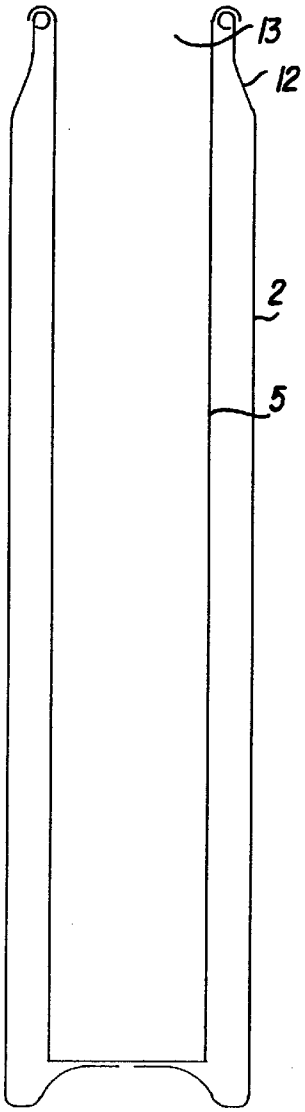
FIGS. 1*a* and 1*b* schematically show known double chamber containers.
Figure 1A:
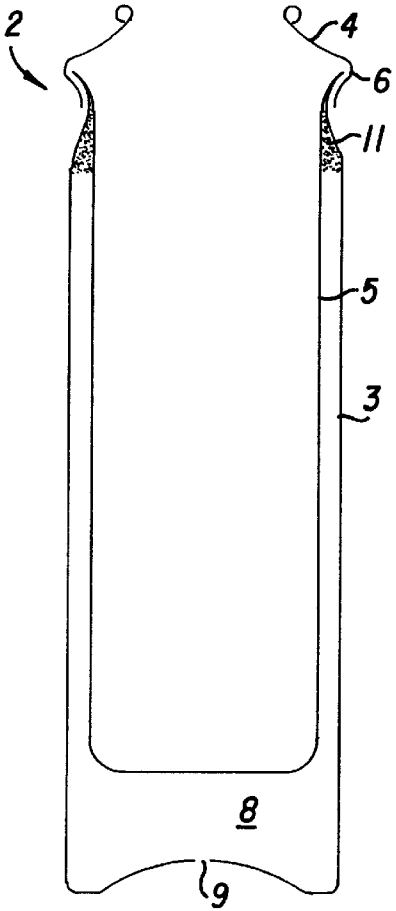

FIG. 1*a* shows a known double chamber container with a two-part outer container 2. This comprises an essentially cylindrical container body 3 and a lid or dome part set thereupon. An inner container 5 is laid into the container body 3 of the outer container. The inner container 5, the container body 3 and the lid part (not shown) are connected to each other in a connection zone 6. An opening 9 for introducing the gas into the intermediate space 8 between the inner container 5 and the outer container 2 is provided in the bottom part of the container body 3, this gas opening being pressure-proofly sealable by means of an elastic plug. In order to seal off the intermediate space for the propellant gas, an adhesive and sealing means 11 is provided in the region of the connection zone 6. In this embodiment of the invention the outer container 2 has a total volume of 171 ml and the inner container 5 has a volume of about 120 ml if liquid gas is used as propellant. If compressed gas, for example air, is used as propellant, the filler volume must be further reduced.

The double chamber container shown in FIG. 1*b* has a single part outer container 2 with a conified shoulder area 12. The diameter of the outer container opening 13 corresponds to the diameter of a valve part which is provided for the closure of the double chamber container. Into this outer container 2 an inner container 5 is inserted, whose opening edge lies upon the opening edge 13 of the outer container 2. With this type of construction it is only possible to manufacture double chambered containers where the diameter of the outer container 2 and the diameter of the inner container 5, respectively the diameter of the foreseen valve part do not differ substantially, in order to maintain the intermediate volume within the range prescribed by law. In the embodiment shown, the inner container has a volume of about 80 ml whilst the total volume of the outer container amounts to 175 ml. This means that the ratio of filler product volume to propellant volume is 80:95 instead of maximum 60:40.

Figure 2A:
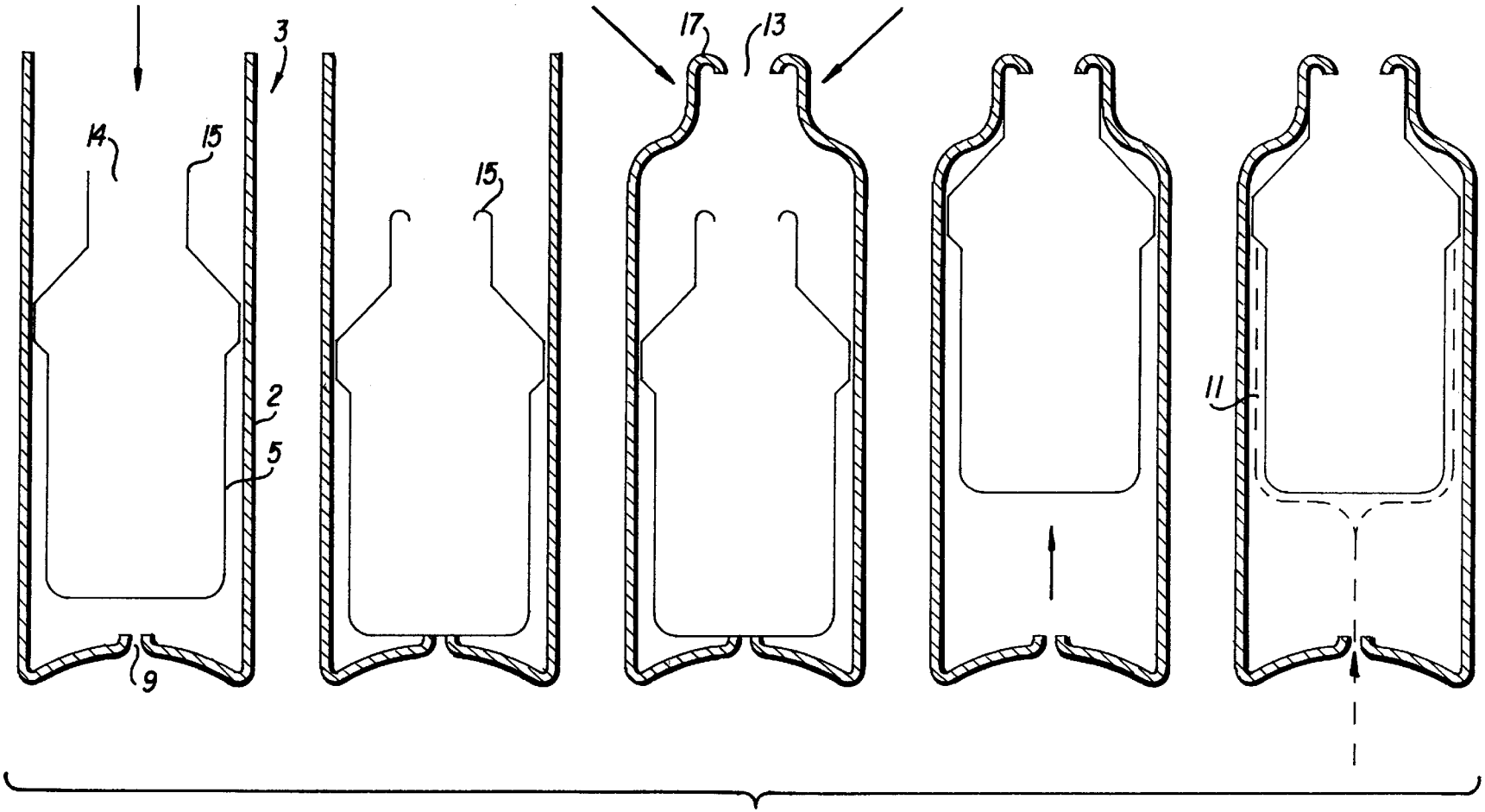
FIGS. 2*a* and 2*b* schematically show the method for manufacturing a double chamber container according to the invention.

FIG. 2*a* schematically shows a method according to the invention. In a first method step the inner container 5 is preformed, and in particular is tapered independently of the outer container 2, whereby the diameter of the inner container opening 14 is adjusted to the diameter of the outer container opening 13 which is sealable with a valve part. In a preferred embodiment of the invention the edge of the inner container opening 14 has an inwardly directed impact surface 15. In a second method step the inner container preformed in this manner is inserted into the cylindrical casing part 3 of the outer container 2 and is retained at the bottom part of the outer container. This can be done pneumatically via the base opening 9. A contact zone 16 which is to be in frictional contact with the outer container 2 can be formed at the inner container 5. The formation of the usually soft annealed and thin inner container 5 can be carried out with any suitable method, and in particular the methods known in the metal processing industry as pressing and drawing techniques. The treatment of the outer container 2 continues in a subsequent method step. This treatment depends on the construction of the outer container, i.e. a can shoulder is formed on a single part outer container 2, whereas a bottom part and/or a lid part is added on a multiple part outer container. The opening edge of the single part outer container 2 preferably comprises an inwardly directed, groove-shaped beading 17. In the following method step the preformed inner container 5 is pushed into the prepared outer container 2 in such a manner, that the opening edge of the preformed inner container 5 lies in fitting contact to the opening edge of the outer container 2. The containers thus positioned are connected to each other in a further method step, and in particular are clinched jointly at their mutual connection zone. It is to be understood that in the case of a multiple part container with dome, the cylindrical casing part is first connected to the dome shaped lid part prior to insertion of the preformed inner container into the casing part. It is also to be understood that in this case, the inner container can be differently dimensioned and, in particular, can have the same length as the outer container. In a last method step a flowable adhesive and sealing means 11 is introduced through the base opening 9.

Figure 2B:
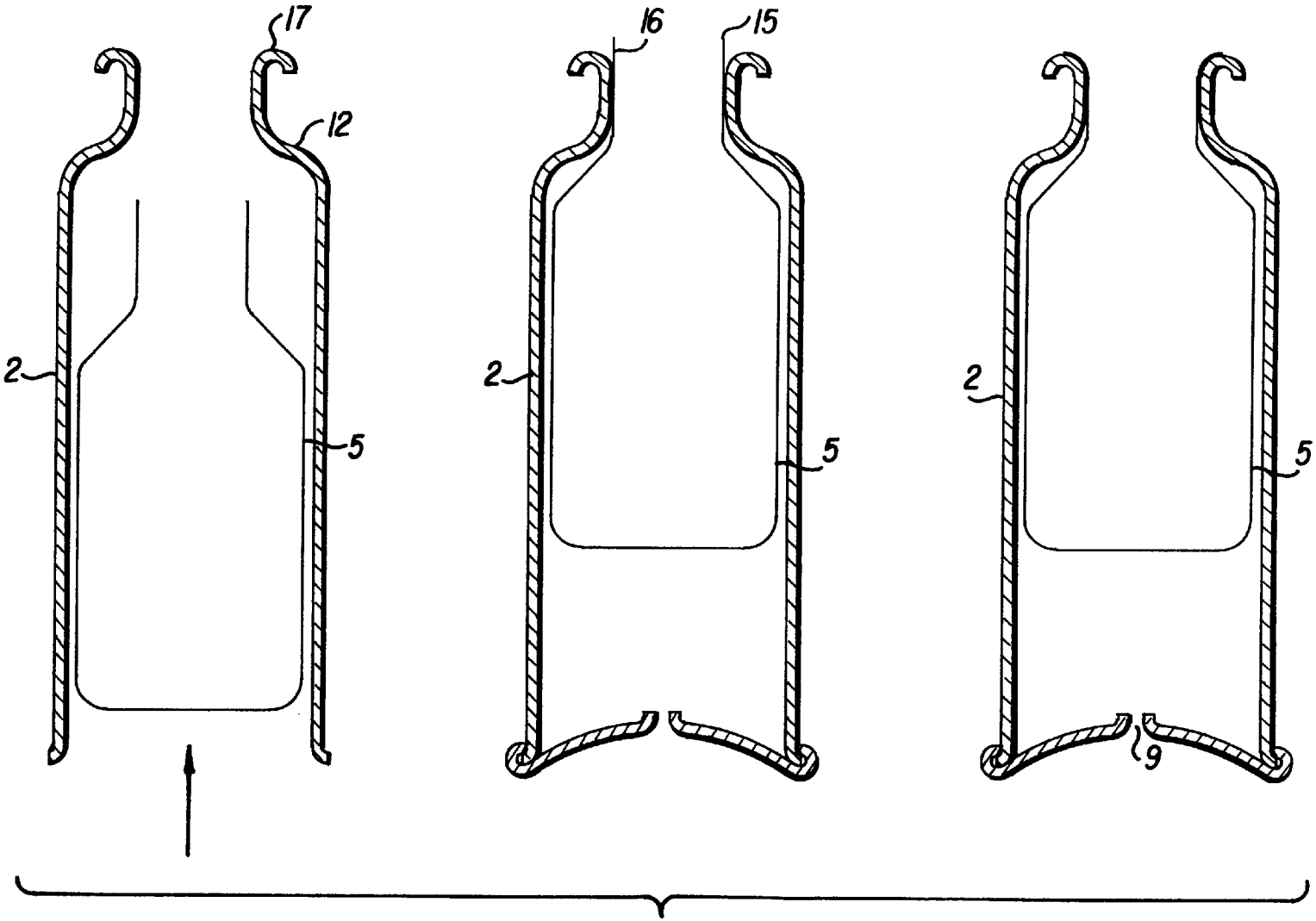

The method shown in FIG. 2*b* only differs from the method described above in that the outer container has a closed beading being directed either inwardly or outwardly, and that the inner container is pushed through the opening of the outer container and, following a suitable expansion of its edge part, is placed onto this beading.

Figure 3B:
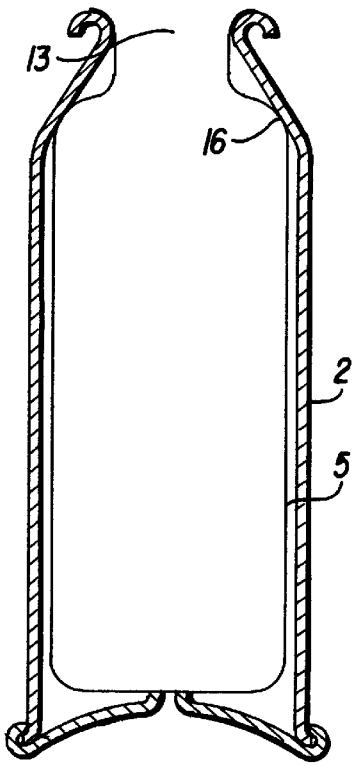
FIGS. 3*a* and 3*b* schematically show an inventive double chamber container.
Figure 3A:
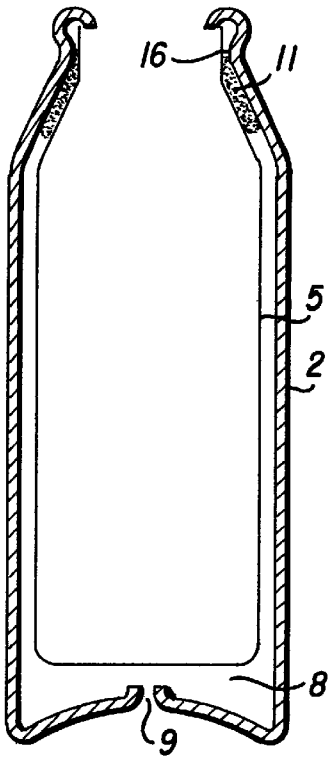

FIGS. 3*a* and 3*b* show a double chamber container manufactured according to the inventive method, and in a preferred embodiment thereof, have a filler product volume of about 130 ml and an outer container volume of 175 ml. In this way a ratio between product and propellant of 70:30 can be achieved. By using tapered inner containers it is possible for the first time to manufacture single part and multiple part double chamber containers for pressure valve cans with large filler volumes using the same production method. By using the inventive method it is possible for the first time to manufacture large filler volume cans where the outer diameter of the can can be chosen independently of the diameter of the sealing valve part.

In a particular embodiment of the invention it has proven to be especially advantageous that the sealing mass 11 of the frictional engagement zone 16 can be kept out of the area to be clinched.

It is to be understood that all materials used for pressure tight cans, in particular aluminium or tin, can be used for the inventive containers, and that the inner container can be provided with an inner protective coating, as is usual for the packaging of medications, foodstuffs or cosmetic products.

Equally, the bottom part of the inner container can be particularly formed, for example to simplify the manipulation of the inner container through the base opening of the outer container, or to influence the collapse behaviour of the entire inner container. For example, in the bottom part a number of recesses can be provided, the bottom part can, as a whole, be conically shaped, or it can have a conically shaped protuberance.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

I claim:

1. Method for manufacturing a double chamber container for a pressure valve can, closable with a valve part, the can being useable for dispensing flowable products, the method comprising the steps of:

forming a compressible metallic inner container being preformed independently with a dome portion, then being inserted into a semi- or completely formed metallic outer container, the upper portion of the outer container being formed with a dome portion to engage the upper portion of the inner container, and to allow a valve part being placed with engaged portion to form a sealed double chamber container.

2. Method according to claim 1 whereby the opening edge of the preformed inner container is inserted into the semi-formed rim of the outer container where it comes to rest, whereupon the edge of the inner container is jointly curled with the semi-formed rim of the outer container, completing the formation of the rim portion of the outer container.

3. Method according to claim 1, whereby the straight ends of the inner container are put in a position protruding the rim of the completely formed outer container, and in a further step the said ends are partially bent over the rim of the said outer container.

4. Method according to claims 1 or 3 whereby the inner container is partially retained in a frictional engagement with the outer container.

5. Method according to claims 1 or 3 further including the step of introducing a flowable adhesive and sealing means between the inner container and outer container.

6. Method according to claims 1 or 3 further comprising the step of providing said inner container with an varnish coating.

7. Double chamber container manufactured according to the method according to claim 1, characterized in that the metallic inner container is preformed in such a manner that it tapers towards the container opening.

8. Double chamber container according to claim 7, characterized in that the opening edge of the preformed inner container lies fittingly at the opening edge of the outer contianer and that the two opening edges are connected to each other in a connection zone.

9. Double chamber container according to claim 7, characterized in that an area of the inner container butts against the outer container.

10. Double chamber container according to claim 7, characterized in that, in the area of a contact zone the inner container lies in frictional engagement to a counter-surface of the outer container.

11. Double chamber container according to claim 7, characterized in that the inner container is made of soft annealed aluminium.

12. Double chamber container according to claim 7, characterized in that the inner side of the inner container is provided with a protective coating, i.e. a lacquer coating.

13. Double chamber container according to claim 7, characterized in that the preformed inner container is pressed or drawn inwardly.

14. Double chamber container according to claim 7, characterized in that a flowable adhesive and sealing means is provided for pressure-tight sealing between the inner container and outer container, in particular an epoxy based adhesive and sealing means, and/or an elastic sealing means is provided between the opening edge and the valve lid.

15. Double chamber container according to claim 14, characterized in that the area provided with adhesive and sealing means between the inner container and outer container lies outside of the connection zone.

16. Pressure-valve can with a double chamber container according to claim 7.

* * * * *